US012209342B2

(12) United States Patent
Tanaka et al.

(10) Patent No.: US 12,209,342 B2
(45) Date of Patent: Jan. 28, 2025

(54) EMBROIDERY SYSTEM

(71) Applicants: Shinya Tanaka, Kanagawa (JP); Teppei Kikuchi, Kanagawa (JP); Yusuke Komine, Kanagawa (JP); Yuuki Gotoh, Kanagawa (JP)

(72) Inventors: Shinya Tanaka, Kanagawa (JP); Teppei Kikuchi, Kanagawa (JP); Yusuke Komine, Kanagawa (JP); Yuuki Gotoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 75 days.

(21) Appl. No.: 18/330,519

(22) Filed: Jun. 7, 2023

(65) Prior Publication Data

US 2023/0416963 A1 Dec. 28, 2023

(30) Foreign Application Priority Data

Jun. 24, 2022 (JP) ..... 2022-102096

(51) Int. Cl.

| | |
|---|---|
| ***D05C 11/24*** | (2006.01) |
| ***D05B 67/00*** | (2006.01) |
| ***D05C 11/06*** | (2006.01) |
| ***D05C 13/02*** | (2006.01) |

(52) U.S. Cl.

CPC ..... *D05C 11/24* (2013.01); *D05B 67/00* (2013.01); *D05C 11/06* (2013.01); *D05C 13/02* (2013.01)

(58) Field of Classification Search

CPC ..... D05C 11/24; D05C 11/16; D05C 5/02; D05C 13/02; D05B 19/08; D05B 19/10; D05B 19/12

See application file for complete search history.

(56) References Cited

U.S. PATENT DOCUMENTS

| | | | | |
|---|---|---|---|---|
| 6,189,989 | B1 * | 2/2001 | Hirabayashi | D05C 11/24 427/288 |
| 2022/0034008 | A1 * | 2/2022 | Eklind | D05B 67/00 |
| 2022/0098776 | A1 | 3/2022 | Yamashita et al. | |

(Continued)

FOREIGN PATENT DOCUMENTS

| | | | | |
|---|---|---|---|---|
| EP | 3978671 | A1 * | 4/2022 | D05B 47/04 |
| EP | 4101649 | A1 * | 12/2022 | B41J 2/165 |

(Continued)

*Primary Examiner* — Danny Worrell

(74) *Attorney, Agent, or Firm* — IPUSA, PLLC

(57) ABSTRACT

An embroidery system includes a data reading device to read three-dimensional data of a design of an embroidery. The embroidery system includes processing circuitry to process the three-dimensional data read by the data reading device, to create embroidery data using height information included in the three-dimensional data. The embroidery system includes an embroidery forming section to form the embroidery on a target object according to the embroidery data created by the processing circuitry. The embroidery system includes a recording head to discharge a liquid droplet from a nozzle. The embroidery system includes control circuitry to control an operation of the recording head. The embroidery data includes data relating to an embroidery density that is a density of a thread in the embroidery and data relating to an application amount of the liquid droplet to be applied to the thread in the embroidery.

3 Claims, 9 Drawing Sheets

(56) References Cited

U.S. PATENT DOCUMENTS

| | | | | |
|---|---|---|---|---|
| 2022/0106720 | A1 | 4/2022 | Gotoh et al. | |
| 2022/0120001 | A1* | 4/2022 | Vlandis | D05C 5/02 |
| 2023/0392312 | A1* | 12/2023 | Ishii | D05B 67/00 |
| 2023/0416963 | A1* | 12/2023 | Tanaka | D05C 5/04 |

FOREIGN PATENT DOCUMENTS

| | | | | |
|---|---|---|---|---|
| EP | 4151792 | A1 * | 3/2023 | D05B 67/00 |
| EP | 4155445 | A1 * | 3/2023 | B41J 11/008 |
| JP | 7-031771 | | 2/1995 | |
| JP | 9-170158 | | 6/1997 | |
| JP | 2000-042268 | | 2/2000 | |
| JP | 2003-210878 | | 7/2003 | |
| JP | 2006-014898 | | 1/2006 | |
| JP | 2020-108961 | | 7/2020 | |

* cited by examiner

EMBROIDERY SYSTEM

CROSS-REFERENCE TO RELATED APPLICATION

This patent application is based on and claims priority pursuant to 35 U.S.C. § 119(a) to Japanese Patent Application No. 2022-102096, filed on Jun. 24, 2022, in the Japan Patent Office, the entire disclosure of which is hereby incorporated by reference herein.

BACKGROUND

Technical Field

Embodiments of the present disclosure relate to an embroidery system.

Related Art

An embroidery data creation apparatus is known in the related art that creates embroidery data according to which an embroidery sewing machine forms an embroidery.

SUMMARY

An embodiment of the present disclosure includes an embroidery system. The embroidery system includes a data reading device to read three-dimensional data of a design of an embroidery. The embroidery system includes processing circuitry to process the three-dimensional data read by the data reading device, to create embroidery data using height information included in the three-dimensional data. The embroidery system includes an embroidery forming section to form the embroidery on a target object according to the embroidery data created by the processing circuitry. The embroidery system includes a recording head to discharge a liquid droplet from a nozzle. The embroidery system includes control circuitry to control an operation of the recording head. The embroidery data includes data relating to an embroidery density that is a density of a thread in the embroidery and data relating to an application amount of the liquid droplet to be applied to the thread in the embroidery. The processing circuitry: sets the embroidery density according to the height information; sets the application amount of the liquid droplet to a first application amount, when the embroidery density is a first density; and sets the application amount of the liquid droplet to a second application amount that is larger than the first application amount, when the embroidery density is a second density that is higher than the first density. The control circuitry controls the operation of the recording head to adjust the application amount of the liquid droplet to be applied to the thread according to the embroidery data.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
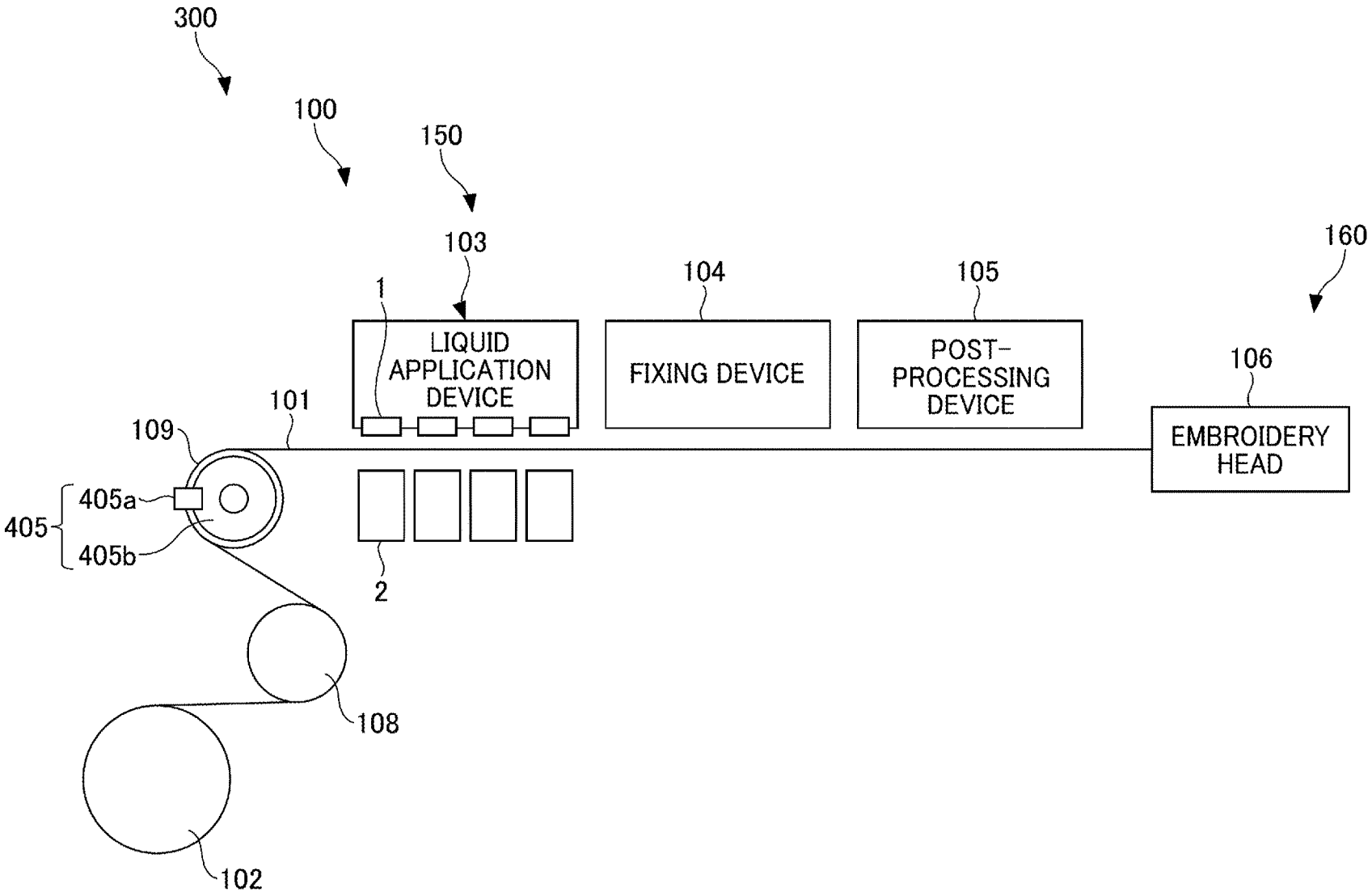
FIG. 1 is a schematic diagram illustrating an embroidery system, according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

An embroidery system according to an embodiment of the present disclosure is described referring to the drawings.

Embroidery System

FIG. 1 is a schematic diagram illustrating an embroidery system 300, according to an embodiment. The embroidery system 300 illustrated in FIG. 1 includes a liquid discharge apparatus 100. The liquid discharge apparatus 100 may be an in-line embroidery apparatus. The liquid discharge apparatus 100 includes a supply reel 102, a liquid application device 103, a fixing device 104, a post-processing device 105, and an embroidery head 106. A thread 101 is wound around the supply reel 102. The thread 101 is a liquid application target member to which liquid is applied. The embroidery head 106 is an example of an embroidery forming section. The embroidery system 300 includes a dyeing device 150 and an embroidery device 160. The dyeing device 150 includes a liquid application device 103, the fixing device 104, and the post-processing device 105. The embroidery device 160 includes the embroidery head 106.

The liquid discharge apparatus 100 includes a plurality of rollers, e.g., a roller 108 and a roller 109, each guiding the thread 101 fed out from the supply reel 102. The thread 101 fed out from the supply reel 102 is guided while contacting the outer circumferential surface of the roller 108 and the roller 109 and is conveyed to the embroidery head 106. The thread 101 is continuously routed from the supply reel 102 to the embroidery head 106.

Figure 2:
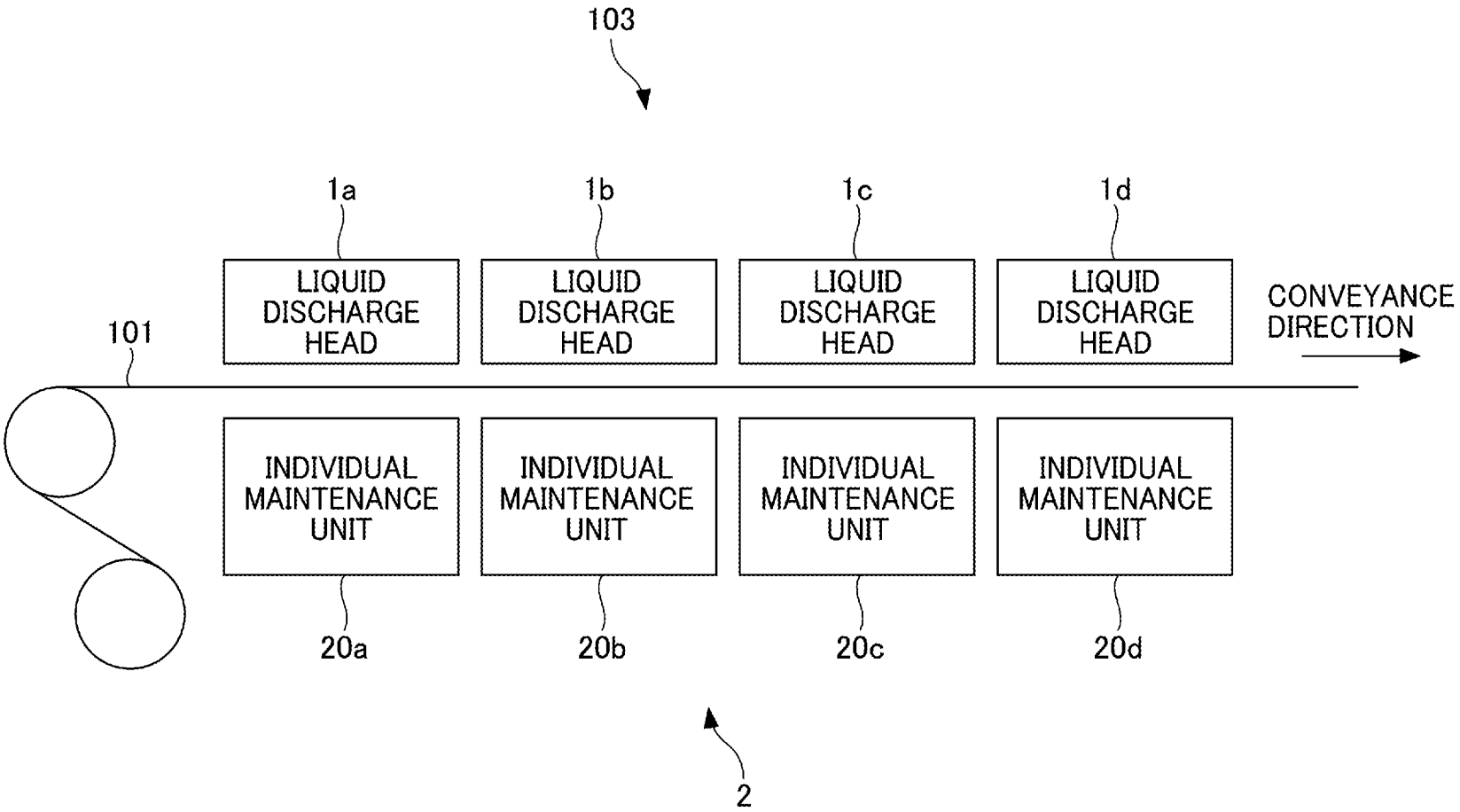
FIG. 2 is a schematic diagram illustrating a liquid application device of a liquid discharge apparatus, according to an embodiment of the present disclosure.

FIG. 2 is a schematic diagram illustrating the liquid application device 103 of the liquid discharge apparatus 100. The liquid application device 103 includes multiple liquid discharge heads and a maintenance unit 2. The multiple liquid discharge heads include, for example, a liquid discharge head 1*a*, a liquid discharge head 1*b*, a liquid discharge head 1*c*, and a liquid discharge head 1*d*. In the following description, the liquid discharge head 1*a*, the liquid discharge head 1*b*, the liquid discharge head 1*c*, and the liquid discharge head 1*d* may be collectively referred to as a "liquid discharge head 1" or "liquid discharge heads 1," to simplify the description, unless they need to be distinguished from one to another. Each of the liquid discharge heads 1 discharges liquid of a desired color to the thread 101. The liquid discharge head 1*a*, the liquid discharge head 1*b*, the liquid discharge head 1*c*, and the liquid discharge head 1*d* respectively discharge liquids of, for example, cyan (C), magenta (M), yellow (Y), and black (K). The liquid discharge head 1 is an example of a recording head.

The maintenance unit 2 includes multiple individual maintenance units 20, e.g., an individual maintenance unit 20*a*, an individual maintenance unit 20*b*, an individual maintenance unit 20*c*, and an individual maintenance unit 20*d*.

The multiple individual maintenance units 20 performs maintenance for the liquid discharge heads 1, respectively. Each of the individual maintenance units 20 performs maintenance operation to eliminate or reduce non-discharge, discharge bending, variation in discharge speed, and variation in discharge amount due to clogging of the liquid discharge heads 1 or thickening of ink, and to maintain or recover the discharge state. The individual maintenance units 20 may perform cleaning operations such as purging, dummy discharge, flushing, and wiping.

Figure 3:
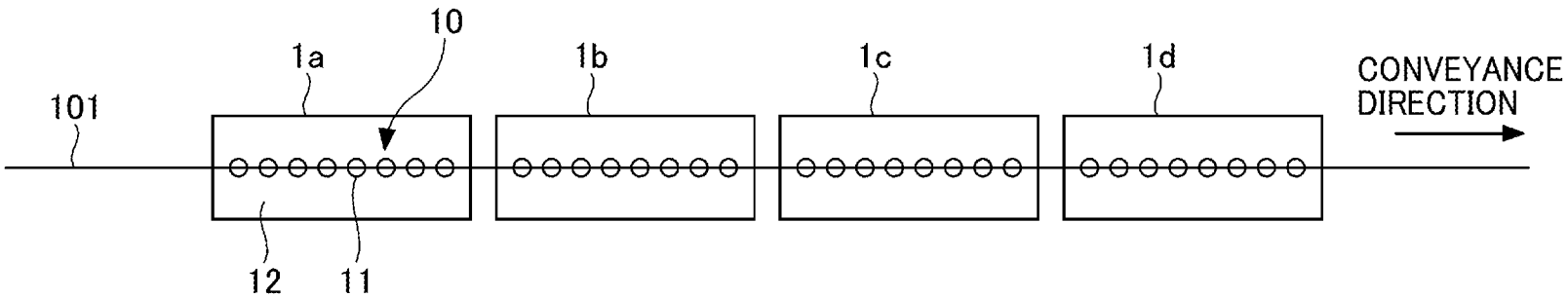
FIG. 3 is a bottom view illustrating liquid discharge heads of the liquid application device, according to an embodiment of the present disclosure.

FIG. 3 is a bottom view illustrating the liquid discharge heads 1 of the liquid application device 103. As illustrated in FIG. 3, each of the liquid discharge heads 1 includes multiple nozzles 11, each discharging liquid. The liquid discharge head 1 includes a surface 12 of a nozzle plate on which the nozzles 11 are formed. The nozzles 11 arranged in the conveyance direction of the thread 101 constitutes a nozzle row 10. The liquid discharge heads 1 are arranged in the conveyance direction of the thread 101.

As illustrated in FIG. 1, the fixing device 104 is disposed downstream from the liquid application device 103 in the conveyance direction of the thread 101. The thread 101 to which liquid is applied by the liquid application device 103 is fed to the fixing device 104. The fixing device 104 performs a fixing process (a drying process) on the thread 101 to which liquid is applied. The fixing device 104 includes a heater that heats the thread 101. Examples of the heater includes, but are not limited to, an infrared irradiator and a hot air sprayer. The fixing device 104 heats the thread 101 to dry the thread.

The post-processing device 105 is disposed downstream from the fixing device 104 in the conveyance direction of the thread 101. The post-processing device 105 may include, for example, a cleaner, a tension adjuster, a feed amount detector, and a lubricant applier. The cleaner cleans the thread 101. The tension adjuster adjusts tension of the thread 101. The feed amount detector detects an amount of movement of the thread 101. The lubricant applier applies a lubricant to the surface of the thread 101.

The embroidery head 106 sews the thread 101 on a cloth, to form embroidery. The cloth is an example of a target object. The cloth is just one example of the target object. Other examples of the target object include, but are not limited to, a sheet-shaped object such as paper or leather.

The liquid discharge apparatus 100 may be applicable to not only to the embroidery apparatus but also to, e.g., an apparatus that uses a linear object such as a thread. Examples of the apparatus that uses the linear object include, but are not limited to, an apparatus such as a loom and a sewing machine.

Examples of the "thread" include glass fiber thread; wool thread; cotton thread; synthetic fiber thread; metallic thread; mixed thread of wool, cotton, polymer, or metal; and linear object (linear member or continuous base material) to which yarn, filament, or liquid can be applied. Examples of the "thread" also include braided cord and flatly braided cord.

Drive Waveform Applier

Figure 4:
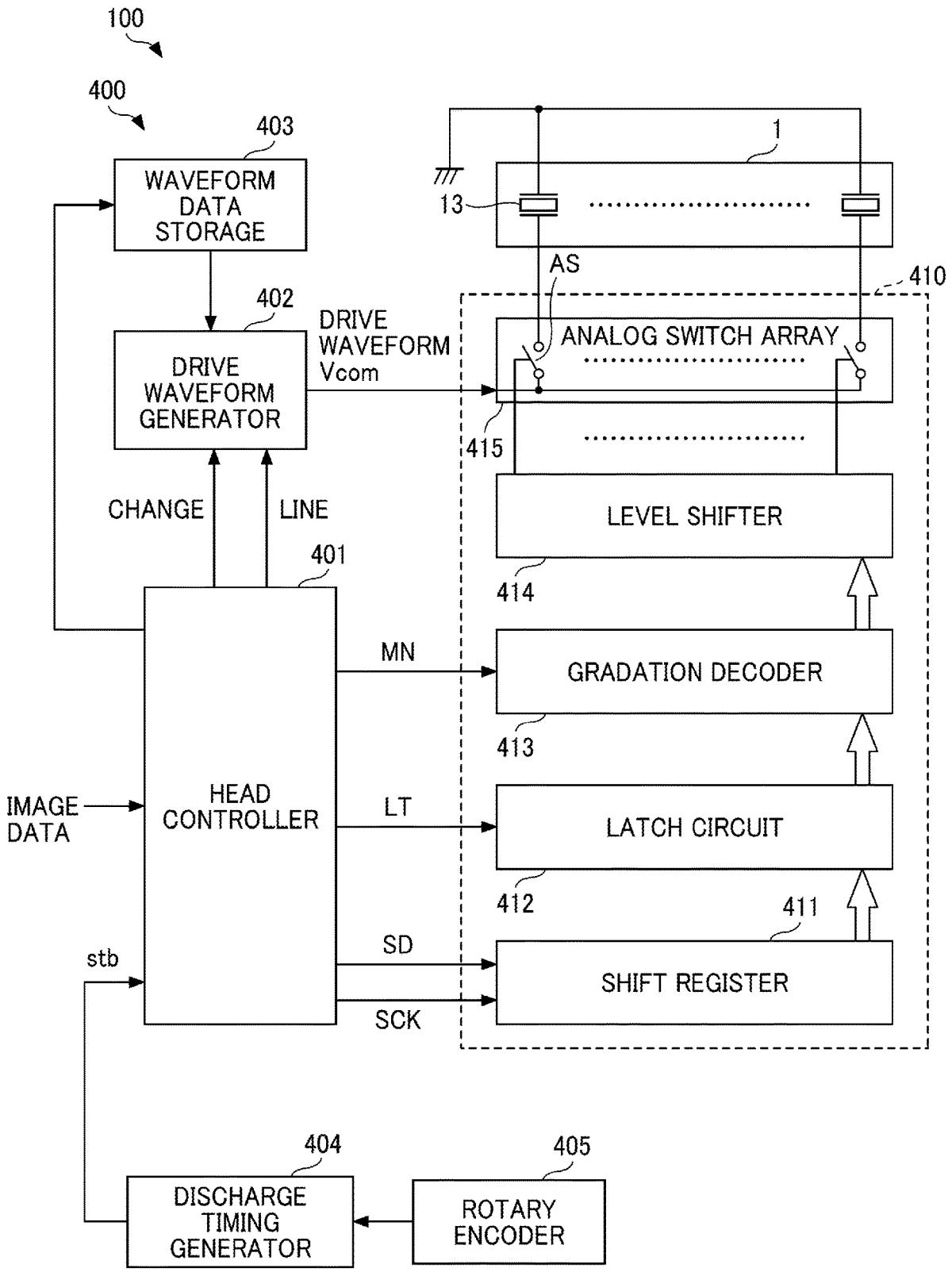
FIG. 4 is a block diagram illustrating a liquid discharge apparatus, according to an embodiment of the present disclosure.

FIG. 4 is a block diagram illustrating the liquid discharge apparatus 100. As illustrated in FIG. 4, the liquid discharge head 1 includes multiple piezoelectric elements 13. Further, the liquid discharge head 1 includes pressure chambers respectively communicating with the nozzles 11. Each of the piezoelectric element 13 applies pressure to liquid in the corresponding pressure chamber, to cause ink in the pressure chamber to be discharged from the nozzle 11.

The liquid discharge apparatus 100 includes a drive waveform applier 400. The drive waveform applier 400 applies a drive waveform to the liquid discharge head 1. The drive waveform applier 400 includes a head controller 401, a drive waveform generator 402, a waveform data storage 403, a head driver 410, and a discharge timing generator 404. The discharge timing generator 404 generates a discharge timing pulse stb indicating a discharge timing. The elements in the drive waveform applier 400 may be implemented by circuitry. In particular, in this example, the head controller 401 may be referred as control circuitry.

In response to a reception of a discharge timing pulse stb, the head controller 401 outputs a discharge synchronization signal LINE that triggers generation of the drive waveform, to the drive waveform generator 402. The head controller 401 outputs a discharge timing signal CHANGE to the drive waveform generator 402. The discharge timing signal CHANGE corresponds to an amount of delay from the discharge synchronization signal LINE.

The drive waveform generator 402 generates a common drive waveform signal Vcom at a timing based on the discharge synchronization signal LINE and the discharge timing signal CHANGE.

The head controller 401 receives image data and generates a mask control signal MN according to the image data. The mask control signal MN is for selecting a predetermined waveform of the common drive waveform signal Vcom according to the size of the liquid droplet to be discharged from each of the nozzles 11 of each of the plurality of the liquid discharge heads 1. The mask control signal MN is a signal at a timing synchronized with the discharge timing signal CHANGE.

The head controller 401 transmits image data SD, a synchronization clock signal SCK, a latch signal LT instructing latch of the image data, and the generated mask control signal MN to the head driver 410.

The head driver 410 includes a shift register 411, a latch circuit 412, a gradation decoder 413, a level shifter 414, and an analog switch array 415.

The shift register 411 receives (inputs) the image data SD and the synchronization clock signal SCK transmitted from the head controller 401. The latch circuit 412 latches each resister value received from the shift register 411 by the latch signal LT transmitted from the head controller 401.

The gradation decoder 413 decodes a value (image data SD) latched by the latch circuit 412 and the mask control signal MN and outputs the result. The level shifter 414 converts a level of a logic level voltage signal of the gradation decoder 413 to a level at which an analog switch AS of the analog switch array 415 is operatable.

The analog switch AS of the analog switch array 415 is turned on or tuned off by an output from the gradation decoder 413 received via the level shifter 414. The analog switch AS is provided for each of the nozzles 11 of the liquid discharge head 1 and is coupled to an individual electrode of each of the piezoelectric elements 13 corresponding to each of the nozzles 11. The common drive waveform signal Vcom from the drive waveform generator 402 is input to the analog switch AS. Further, as described above, the timing of the mask control signal MN is synchronized with the timing of the common drive waveform signal Vcom.

Therefore, the analog switch AS is switched between on and off timely in accordance with the output from the gradation decoder 413 via the level shifter 414. With this operation, the waveform to be applied to the piezoelectric element 13 corresponding to each of the nozzles 11 is selected from the drive waveforms forming the common drive waveform Vcom. As a result, the size of the droplet discharged from the each of the nozzles 11 is controlled.

The discharge timing generator 404 generates and outputs the discharge timing pulse stb each time the thread 101 is moved by a predetermined amount, on the basis of the detection result of the rotary encoder 405 that detects a rotation amount of the roller 109 illustrated in FIG. 1. The rotary encoder 405 includes an encoder wheel 405*a* that rotates together with the roller 109 and an encoder sensor 405*b* that reads the slit in the encoder wheel 405*a*.

The thread 101 is conveyed (moved) as the thread is consumed in an embroidery operation by the embroidery head 106 that is provided downstream in the conveyance direction of the thread 101. As the thread 101 is fed, the roller 109 guiding the thread 101 rotates to rotate the encoder wheel 405*a* of the rotary encoder 405. The encoder sensor 405*b* generates and outputs an encoder pulse proportional to the linear velocity of the thread 101.

The discharge timing generator 404 generates the discharge timing pulse stb on the basis of the encoder pulse from the rotary encoder 405. The discharge timing pulse stb is used as the discharge timing of the liquid discharge head 1. The application of liquid to the thread 101 is started as the thread 101 starts moving. Even if the linear speed of the thread 101 changes, the drive waveform, an interval of the discharge timing pulse stb changes according to the encoder pulse, whereby preventing deviation in a landing position of the ink droplet on the thread 101.

Embroidery Data Creation Section

Figure 5:
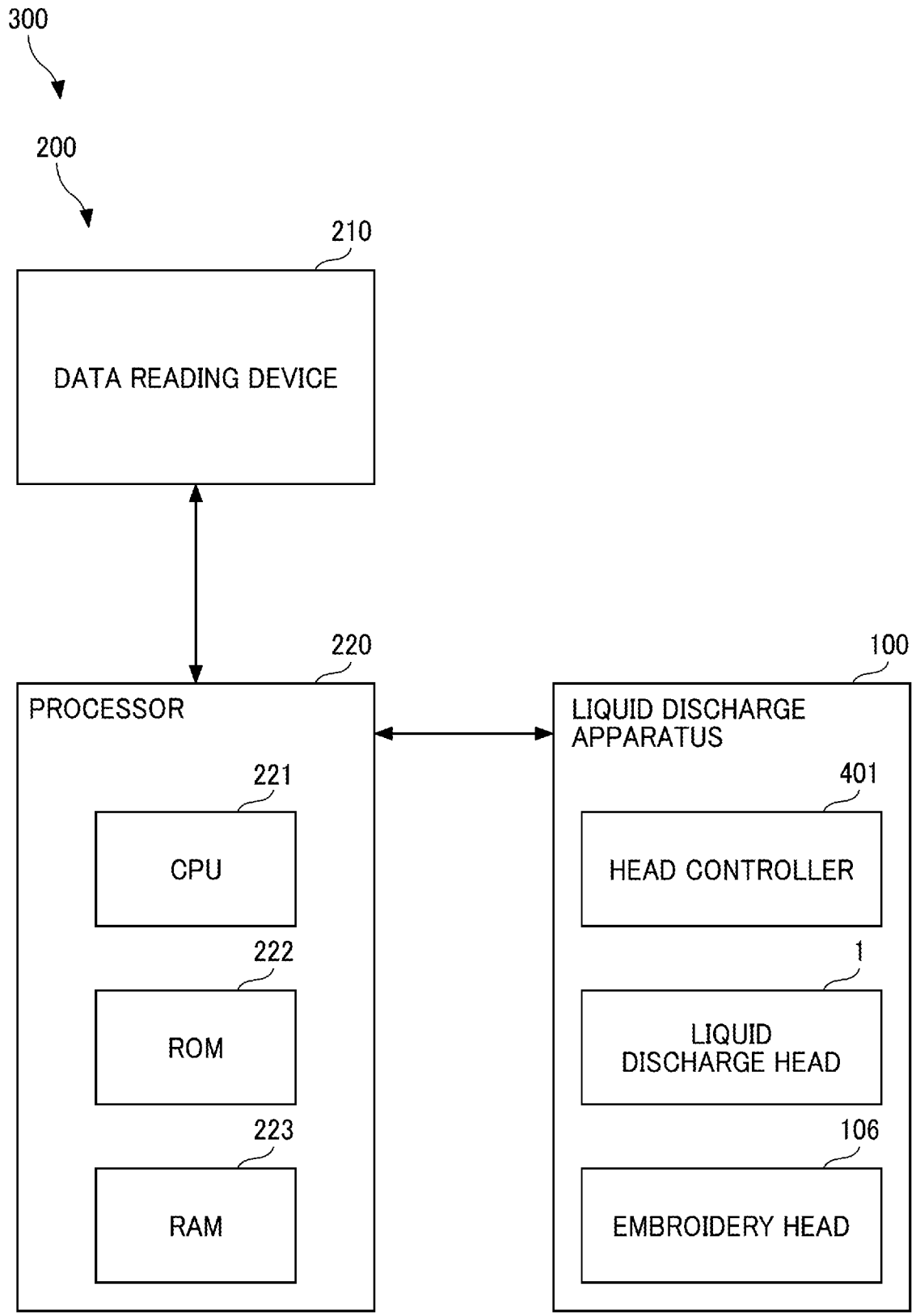
FIG. 5 is a block diagram illustrating the embroidery system, according to an embodiment of the present disclosure.

Referring to FIG. 5, a description is now provided of an embroidery data creation section 200. As illustrated in FIG. 5, the embroidery system 300 includes an embroidery data creation section 200. The embroidery data creation section 200 includes a data reading device 210 and a processor 220. The embroidery data creation section 200 creates embroidery data from original data as a source of embroidery. The embroidery data creation section 200 outputs the created embroidery data to the liquid discharge apparatus 100. Alternatively, the liquid discharge apparatus 100 may include the embroidery data creation section 200.

Data Reading Device

The data reading device 210 illustrated in FIG. 5 reads three-dimensional data of an object as a source of embroidery (a design of embroidery). The data reading device 210 may be, for example, a three-dimensional scanner. Alternatively, the data reading device 210 may be a camera, for example. The data reading device 210 may include, for example, a memory that stores data. The data reading device 210 can acquire the original data.

Original Data

The original data is, for example, data relating to an object as a source of embroidery (a design of embroidery). The original data includes three-dimensional information of the object as the source of embroidery. The three-dimensional information (3D data) includes two-dimensional information (2D data) and height information. The original data may include image data (original picture data) relating to a photograph obtained by photographing an object as the source of embroidery. The image data includes data relating to a color of the object as the source of embroidery. The image data may include other information than the data relating to color.

Three-Dimensional Information

The three-dimensional information includes, for example, information on positions in an X-axis direction, a Y-axis direction, and a Z-axis direction orthogonal to each other.

Two-Dimensional Information

The two-dimensional information includes data of, for example, a position and a shape of the object as the source of embroidery (the design of embroidery). The two-dimensional information includes information on positions in the X-axis direction and the Y-axis direction.

Height Information

The height information is information relating to a height of the object as a source of embroidery (a design of embroidery). The height information may be information relating to a height from a reference position of the object as the source of embroidery. The height information includes information on a position in the Z-axis direction. The height information may be information relating to a thickness of the object as the source of embroidery.

Figure 6:
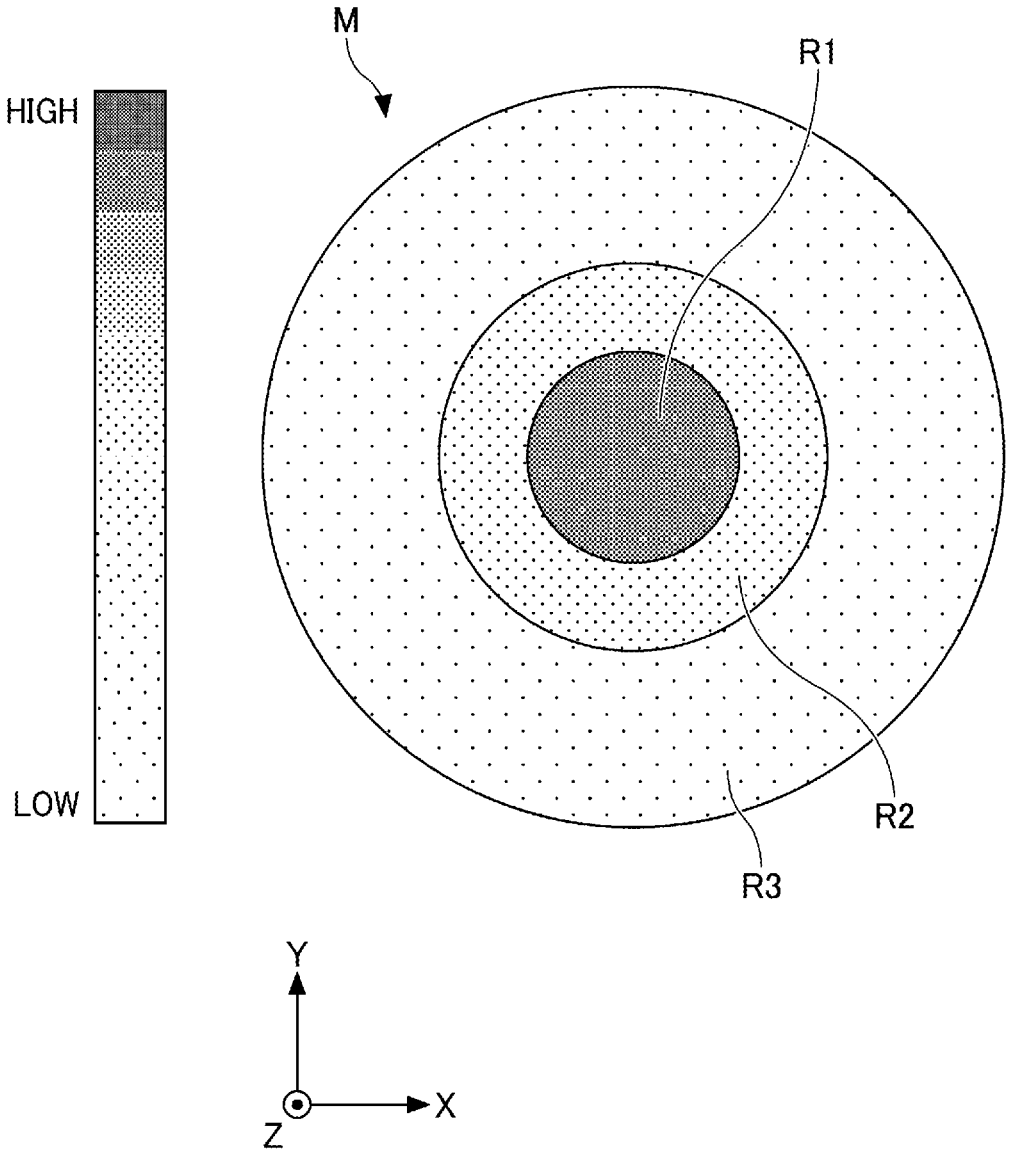
FIG. 6 is a schematic diagram illustrating an example of data contained in three-dimensional information of a model M as a source of embroidery, according to an embodiment of the present disclosure.
Figure 7:
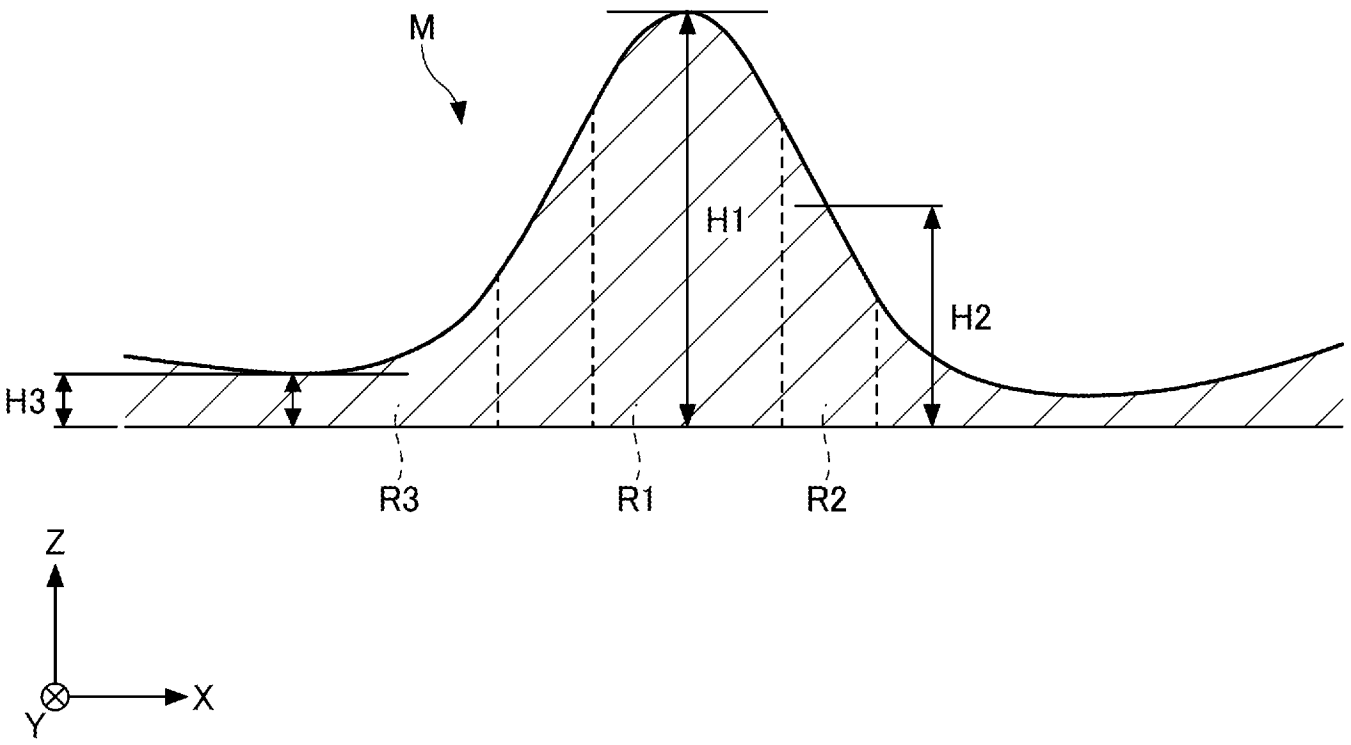
FIG. 7 is a cross-sectional view of the model M as a source of embroidery along a height direction of the model M, according to an embodiment of the present disclosure.

FIG. 6 is a schematic diagram illustrating an example of data contained in the three-dimensional information of a model M as a source of embroidery. FIG. 7 is a cross-sectional view of the model as a source of embroidery along a height direction of the model M. The model M is an example of an object. The data as illustrated in FIG. 6 can be acquired by reading the model M as the source of embroidery by the data reading device 210. The data illustrated in FIG. 6 includes two-dimensional information indicating a shape of the model M and height information of an area R1, an area R2, and an area R3 included in the model M.

The model M includes multiple areas, e.g., the area R1, the area R2, and the area R3. The model M is divided into the multiple areas, e.g., the area R1, the area R2, and the area R3 according to the height information. The area R1 is, for example, a portion that forms a circular shape at the center.

The area R2 is an annular portion surrounding the area R1. The area R3 is an annular portion surrounding the area R2.

As illustrated in FIG. 7, a height H1 of the area R1 is higher than a height H2 of the area R2. The height H2 of the area R2 is higher than a height H3 of the area R3. The height information includes the heights H1 to H3 of the areas R1 to R3. The height H1 of the area R1 may be a height that is highest in the area R1. The height H2 of the area R2 may be an average height of the area R2. The height H3 of the area R3 may be a height that is lowest in the area R3.

In FIG. 6, the height information is expressed by, for example, gradation. The lower the value of the height information, the lighter the gradation color. The higher the value of the height information, the darker the gradation color. The area R1 is illustrated in a darker color than the area R2 and the area R3. The area R2 is illustrated in a darker color than the area R3.

Embroidery Data

Embroidery data includes coordinates indicating a position at which a needle of the embroidery head 106 is to be inserted and data indicating an order in which the needle is to be inserted. The embroidery data may be continuous data relating to the order in which the needle is to be inserted.

The embroidery data is data containing embroidery parameters such as a thread density (embroidery density) and a sewing direction. The embroidery data further includes data relating to an amount of liquid droplets to be applied to the thread used for embroidery. The embroidery data may include data relating to a stitch width. The stitch width may be set according to the height information.

The embroidery data is data in which data of coordinates to which the needle is to be moved is associated with items to be executed at the corresponding coordinates. Examples of the items to be executed at the corresponding coordinate include operation such as: (1) inserting the needle into a cloth to catch the lower thread and then return the needle to the surface of the cloth; (2) after the operation of (1), moving the needle to the next position at which the needle is to inserted; (3) cutting the thread to end the embroidery; and (4) moving the needle to an initialization position.

Thread Density

Figure 8:
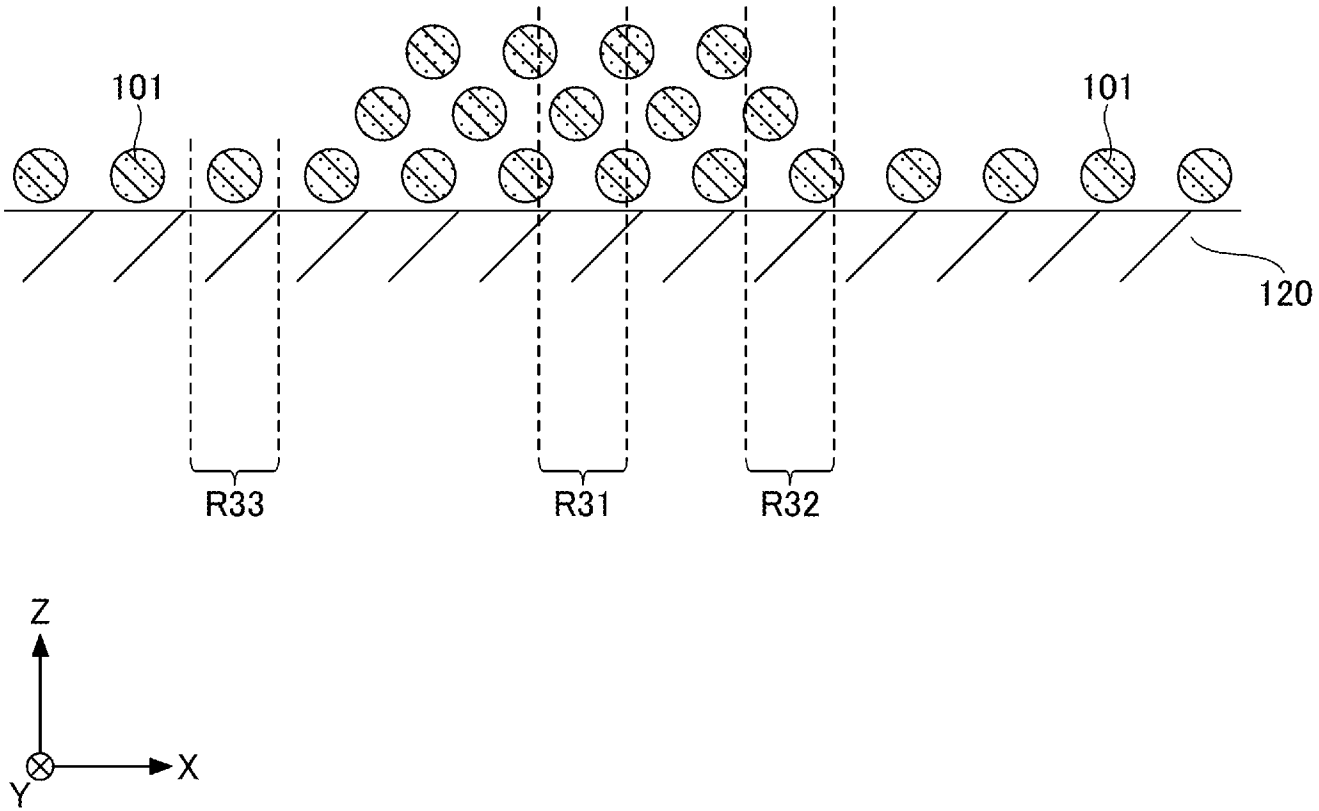
FIG. 8 is a cross-sectional view of an example of a thread density in embroidery, according to an embodiment of the present disclosure.

FIG. 8 is a cross-sectional view of an example of a thread density in embroidery. A density of the thread 101 may be, for example, the number of threads 101 in a predetermined area. The density of the thread 101 may be, for example, a thickness of the thread 101 in a predetermined area. The density of the thread 101 may be a value indicating whether the value is larger or smaller than a reference value.

The density of the thread 101 is changeable according to the height information. For example, the thread density in an area R31 that corresponds to the area R1 is, for example, a thread density D1. The thread density in an area R32 that corresponds to the area R2 is, for example, a thread density D2. The thread density in an area R33 that corresponds to the area R3 is, for example, a thread density D3. The thread density D1, the thread density D2, and the thread density D3 are higher in the order of the thread density D3, the thread density D2, and the thread density D1.

The thread density D1 of the area R31 in which the value of the height information is small is higher than the thread density D2 and the thread density D3 of the area R32 and the area R33 in which the value of the height information is smaller than the value of the height information of the area R31. The thread density D3 of the area R33 in which the value of the height information is small is lower than the thread density D1 and the thread density D2 of the area R31 and the area R32 in which the value of the height information is larger than the value of the height information of the area R33. The values of the thread densities are greater (D1>D2>D3) in descending order of the height information (H1>H2>H3).

Processor

The processor 220 acquires data from the data reading device 210 and processes the acquired data.

The processor 220 may be, for example, an image processor, and may be referred to as processing circuitry. The processor 220 includes, for example, a central processing unit (CPU) 221, a read only memory (ROM) 222, and a random access memory (RAM) 223. The processor 220 performs data processing, to create the embroidery data from the image data.

The processor 220 can determine the embroidery parameter according to the height information included in the original data. The processor 220 reflects the embroidery parameter in the embroidery data.

When the value of the height information included in the original data is large, the processor 220 can set the thread density higher than when the value of the height information included in the original data is small. When the value of the height information indicates a first height, the processor 220 can set the thread density to a first density. When the value of the height information indicates a second height, which is higher than the first height, the processor 220 can set the thread density to a second density, which is higher than the first density. The processor 220 can set the thread density to be higher as the value of the height information is larger. The processor 220 can set the thread density to be lower as the value of the height information is smaller.

As illustrated in FIG. 8, the thread density D1 of the area R31 in which the value of the height information (height H1) is the largest is higher than the thread density D2 and the thread density D3 of the area R32 and the area R33 in which the values of the height information (height H2 and height H3) are lower than the value of the height information of the area R31. In other words, D1>D2>D3. The thread density D3 of the area R33 in which the value of the height information (height H3) is the smallest is lower than the thread density D1 and the thread density D2 of the area R31 and the area R32 in which the values of the height information (height H1 and height H2) are larger than the value of the height information of the area R33. The processor 220 can thus set the thread density D1, the thread density D2, and the thread density D3 according to the height information.

The processor 220 can set an application amount of liquid droplets to be applied to the thread 101. When the density of the thread 101 is a first density, the processor 220 can set the application amount of the liquid droplets to a first application amount. When the density of the thread 101 is a second density, which is higher than the first density, the processor 220 can set the application amount of the liquid droplets to a second application amount, which is larger than the first application amount. The processor 220 can set the amount of liquid droplets to be larger in an area where the density of the thread 101 is higher. The processor 220 can set the amount of liquid droplets to be smaller in an area where the density of the thread 101 is lower.

The embroidery data creation section 200 outputs the created embroidery data to the liquid discharge apparatus 100. The liquid discharge head 1 can discharge liquid droplets according to the application amount of the liquid droplets set in the embroidery data. The embroidery data includes data relating to a color of the liquid droplets and data relating to the discharge amount.

Embroidery Head

The embroidery head 106 inserts a needle into a cloth 120 to cause to catch a lower thread. The embroidery head 106 returns the needle to the surface of the cloth 120. The embroidery head 106 moves the needle to a position at which the needle is to be inserted next. The embroidery head 106 inserts the needle to adjust an arrangement interval of the threads 101 so that the thread density set by the embroidery data is implemented.

Embroidery Data Creation

Figure 9:
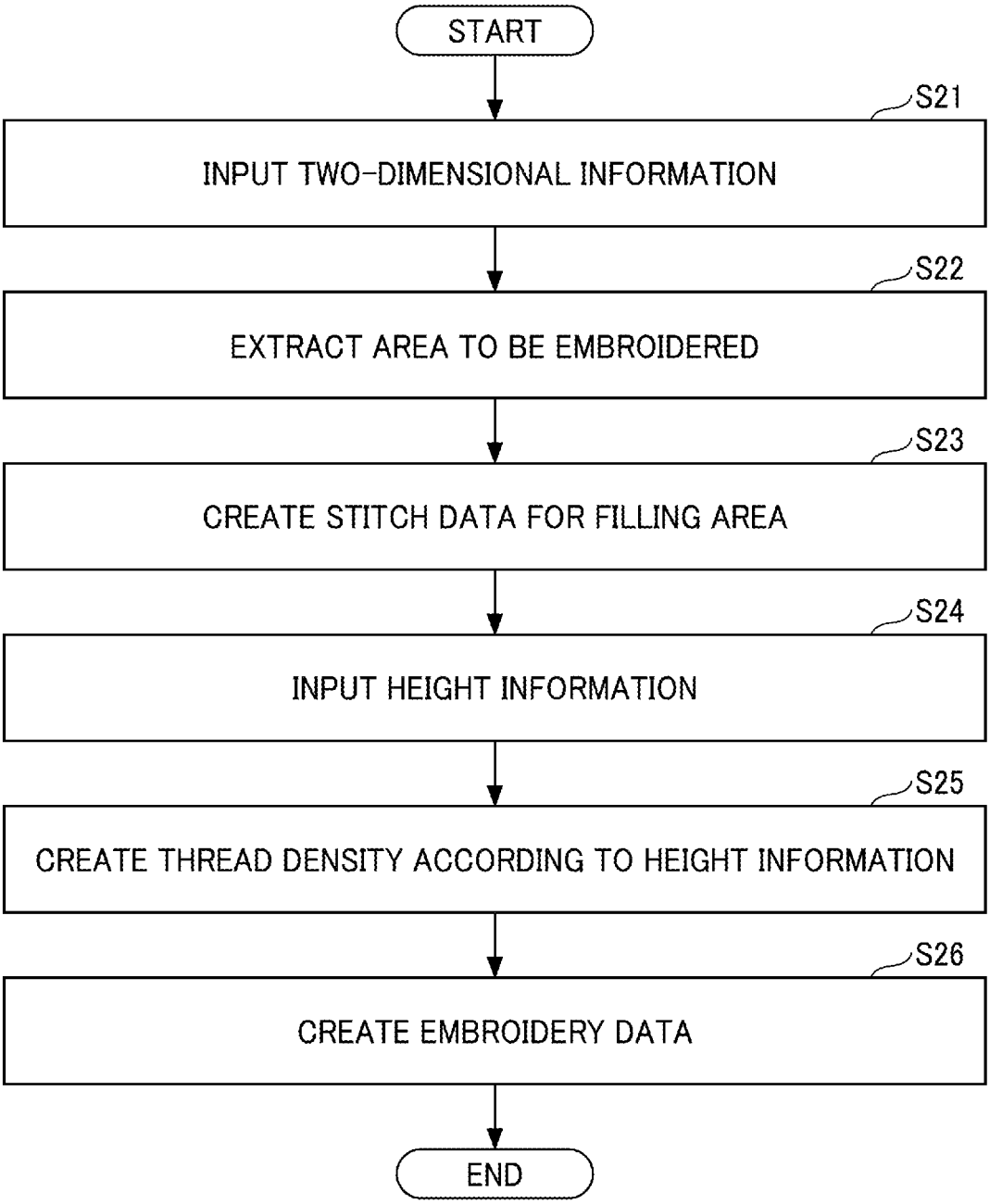
FIG. 9 is a flowchart illustrating an operation of creating embroidery data, according to an embodiment of the present disclosure.

Referring to FIG. 9, a description is now provided of an operation of creating embroidery data. FIG. 9 is a flowchart illustrating an operation of creating embroidery data. First, the data reading device 210 acquires an embroidery model (the model M) as a source of embroidery. The data reading device 210 reads three-dimensional information of the embroidery model. The three-dimensional information includes the two-dimensional information (2D data) and the height information (height data) as described above.

As illustrated in FIG. 9, the processor 220 inputs (receives) the two-dimensional information from the data reading device 210 (step S21). The processor 220 extracts an area for which embroidery is to be performed (step S22). The processor 220 can extract, from the two-dimensional information, an area of an object as an embroidery target and an area of a background other than the object. The processor 220 can set the area of the object as the embroidery target as an area to be embroidered.

In step S23, the processor 220 creates stitch data to fill the area to be embroidered. The stitch data includes, for example, a stitch width and coordinates of a position where a needle is to be inserted.

The processor 220 inputs (receives) the height information from the data reading device 210 (step S24). The processor 220 divides the model M to the area R1, the area R2, and the area R3 respectively for the height information items (height H1, height H2, and height H3). The height information is associated with, for example, coordinate data, which is two-dimensional information. The processor 220 sets the thread density according to the height information (step S25). The processor 220 can set the thread density to be higher as the value of the height information is higher. The processor 220 sets the thread density R1, the thread density R2, and the thread density R3 respectively for the area D1, the area D2, and the area D3. The processor 220 creates the embroidery data other than the thread density (step S26). The processor 220 may create the embroidery data so as to set color information for each of the areas. The processor 220 can create inkjet printing data from the color information and the embroidery data. The processor 220 can output the embroidery data and the printing data to the head controller 401 of the liquid discharge apparatus 100.

Operation Control of Liquid Discharge Head

The head controller 401 controls operation of the liquid discharge head 1 to cause liquid to adhere to the thread 101 according to the embroidery data (printing data). The head controller 401 controls operation of the liquid discharge head 1 to adjust an amount of liquid discharged onto the thread 101 according to the stitch width W included in the embroidery data.

In one example, the head controller 401 controls the operation of the liquid discharge head 1 so that the higher the thread density, the greater the discharge amount of the liquid. The head controller 401 controls the operation of the liquid discharge head 1 so that the lower the thread density, the smaller the discharge amount of the liquid.

The head controller 401 controls the operation of the liquid discharge head 1 to adjust an amount of liquid droplets to be applied to the thread according to the embroidery data. The head controller 401 controls the operation of the liquid discharge head 1 so that the application amount of the liquid droplets is set to the first application amount when the density of the thread is the first density, and the application amount of the liquid droplets is set to the second application amount, which is larger than the first application amount, when the density of the thread is the second density, which is higher than the first density. The head controller 401 controls the operation of the liquid discharge head 1 so that the application amount of liquid droplets is larger in an area where the density of the thread is higher. The head controller 401 controls the operation of the liquid discharge head 1 so that the application amount of liquid droplets is smaller in an area where the density of the thread is lower.

Operation Control of Embroidery Head

The head controller 401 controls operation of the embroidery head 106 to form an embroidery according to the embroidery data.

According to the embroidery system 300 of the present embodiment, the data reading device 210 reads original data, and a thread density is set on the basis of height information of an object, the height information being included in the original data. Further, an application amount of liquid droplets to be applied to the thread is set to the first application amount when the thread density is the first density, and the application amount of the liquid droplets to be applied to the thread is set to the second application amount, which is larger than the first application amount, when the thread density is the second density, which is higher than the first density. The embroidery system 300 can set the application amount of the liquid droplets to be larger in an area where the density of the thread is higher. Further, the embroidery system 300 can set the application amount of the liquid droplets to be smaller in an area where the density of the thread is lower. A height can be expressed in an embroidery that is formed by the embroidery system 300 according to the embroidery data.

Further, in the embroidery system 300, when the value of the height information indicates the first height, the processor 220 can set the thread density to the first density. When the value of the height information indicates the second height, which is higher than the first height, the processor 220 can set the thread density to the second density, which is higher than the first density. Thus, the embroidery system 300 can increase the thread density and the application amount of liquid droplets as the height of a part of an object as a source of the embroidery (a design of embroidery) increases. The embroidery system 300 can decrease the thread density and the application amount of liquid droplets as the height of a part of an object as a source of the embroidery decreases. As a result, the thread density and the shade of a color of the thread change on the basis of the height information, thereby making a difference in height stand out in the formed embroidery. According to the embroidery system 300, an embroidery having a more three-dimensional texture can be created.

Further, according to the embroidery system 300, the liquid discharge head 1 includes a pressure chamber that applies pressure to a liquid droplet. The liquid discharge apparatus 100 discharges a liquid droplet to which pressure is applied from the nozzle 11 and cause the liquid droplet to adhere to the thread 101. Such an application of the liquid discharge head 1 of an inkjet type makes it possible to discharge ink with high accuracy and color the thread 101.

The liquid discharge apparatus 100 can create an embroidery in which a color changes in one surface area such as gradation expression. This configuration enhances the range of design and expression by embroidery.

In the related art, a single-color thread that is uniformly dyed in advance is typically used for embroidery. According to the liquid discharge apparatus 100, unlike the embroidery of the related art, a thread does not have to be switched (in other words, a needle does not have to be inserted) for color switching, the degree of freedom in how a needle is inserted is enhanced. This enhances the degree of freedom of an embroidery pattern. The liquid discharge apparatus 100 can further enhance the expressiveness of embroidery based on photograph data having a wide range of colors.

The liquid discharge apparatus 100 including the liquid discharge head 1 of an inkjet type can enhance a degree of freedom of a sewing method in addition to widening the range of colors, thereby enhancing a texture and a three-dimensional effect of embroidery.

In the related art, an embroidery data creation apparatus just forms embroidery according to embroidery data. Height is not expressed in the formed embroidery.

According to one embodiment of the present disclosure, an embroidery system is provided that forms embroidery according to embroidery data, wherein height is expressed in the formed embroidery.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. An embroidery system comprising:

a data reading device configured to read three-dimensional data of a design of an embroidery;

processing circuitry configured to process the three-dimensional data read by the data reading device, to create embroidery data using height information included in the three-dimensional data;

an embroidery forming section configured to form the embroidery on a target object according to the embroidery data created by the processing circuitry;

a recording head configured to discharge a liquid droplet from a nozzle; and control circuitry configured to control an operation of the recording head, wherein the embroidery data includes:

data relating to an embroidery density that is a density of a thread in the embroidery; and data relating to an application amount of the liquid droplet to be applied to the thread in the embroidery, and wherein the processing circuitry is further configured to:

set the embroidery density according to the height information;

set the application amount of the liquid droplet to a first application amount, when the embroidery density is a first density; and set the application amount of the liquid droplet to a second application amount that is larger than the first application amount, when the embroidery density is a second density that is higher than the first density, and wherein the control circuitry is further configured to control the operation of the recording head to adjust the application amount of the liquid droplet to be applied to the thread according to the embroidery data.

2. The embroidery system of claim 1, wherein the processing circuitry is further configured to:

set the embroidery density to the first density, when a value of the height information indicates a first height; and set the embroidery density to the second density, when the value of the height information indicates a second height that is higher than the first height.

3. The embroidery system of claim 1, wherein the recording head includes a pressure chamber configured to apply a pressure to the liquid droplet, and the recording head discharges the liquid droplet to which the pressure is applied from the nozzle, to cause the liquid droplet to adhere to the thread.

* * * * *